United States Patent [19]

Cuddy et al.

[11] Patent Number: 4,871,588

[45] Date of Patent: Oct. 3, 1989

[54] METHOD AND APPARATUS FOR ACCENT COATING OF LAP PANELS

[75] Inventors: Jared G. Cuddy, Utica; William H. Juntunen, Southfield, both of Mich.

[73] Assignee: Abitibi-Price Corporation, Troy, Mich.

[21] Appl. No.: 237,954

[22] Filed: Aug. 29, 1988

[51] Int. Cl.[4] ..... B05D 3/04; B05D 3/12; B05D 5/00; B05C 11/06

[52] U.S. Cl. ..... 427/264; 118/50; 118/63; 118/102; 118/110; 118/DIG. 9; 427/270; 427/297

[58] Field of Search ..... 118/63, 102, DIG. 9, 118/103, 110, 50; 427/267, 273, 278, 262, 297, 264, 270

[56] References Cited

U.S. PATENT DOCUMENTS

| | | | |
|---|---|---|---|
| 3,339,525 | 9/1967 | Roberts | 118/63 |
| 3,678,890 | 7/1972 | Ehrensing et al. | 118/63 |
| 3,796,586 | 3/1974 | Hanlon et al. | 427/267 X |
| 3,908,588 | 9/1975 | Daunheimer et al. | 118/102 X |
| 3,936,541 | 2/1976 | Plowman et al. | 427/262 |
| 4,128,076 | 12/1978 | Daunheimer | 118/70 |

*Primary Examiner*—Evan Lawrence

*Attorney, Agent, or Firm*—Barnes, Kisselle, Raisch, Choaate, Whittemore & Hulbert

[57] ABSTRACT

A method of coating embossed panels having embossed panel portions which are offset in generally parallel planes. A liquid accent coating is applied to the panels as they are moved along a predetermined path. A roll is reverse rotated to wipe liquid coating from the high points of the embossed panel surfaces, creating a high level of contrast with the relief portions where a greater amount of coating remains. The rolls do not wipe the steps between panel portions so that the steps are more heavily coated, to create a dark shadow line. Doctor blades strip coating from the roll, except in those portions that do not contact the panel steps. Vacuum removes excess coating from the stepped areas of the panels and also from those portions of the rolls not contacted by the doctor blades. Apparatus for carrying out the method is also disclosed.

26 Claims, 3 Drawing Sheets

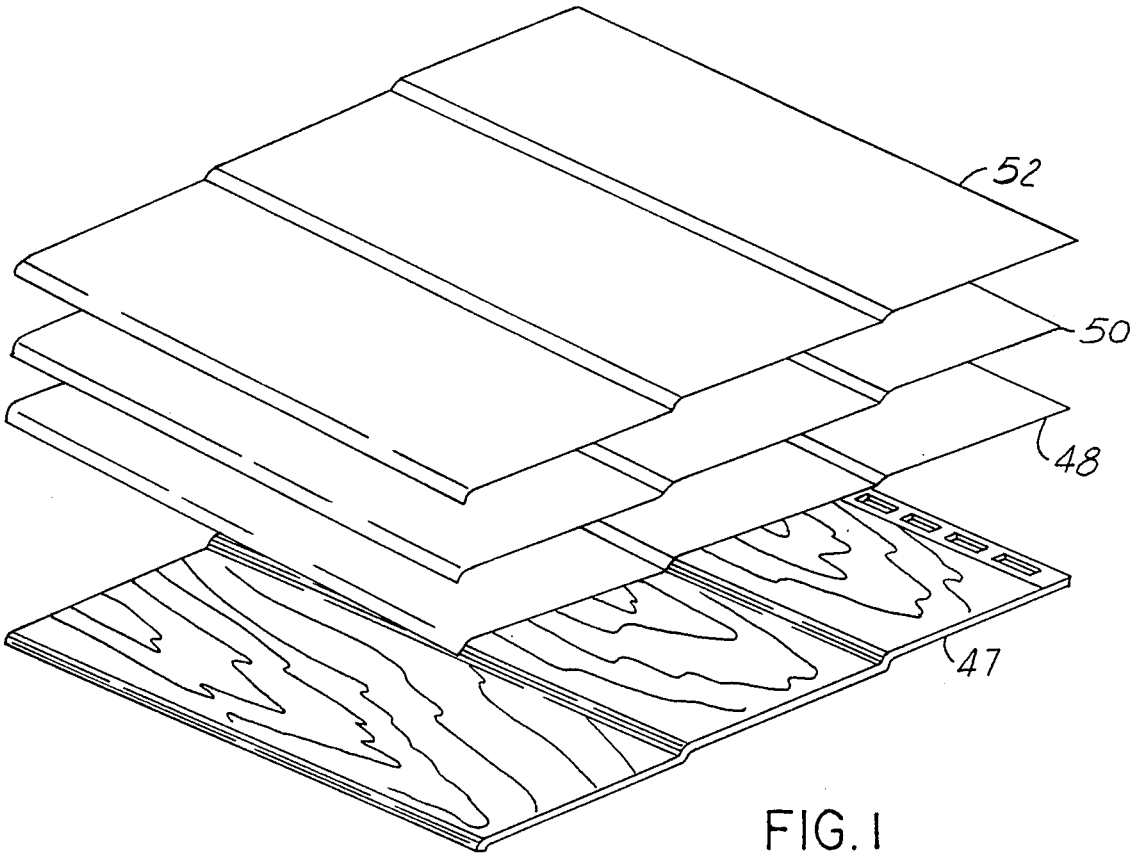
FIG. 1
FIG. 2
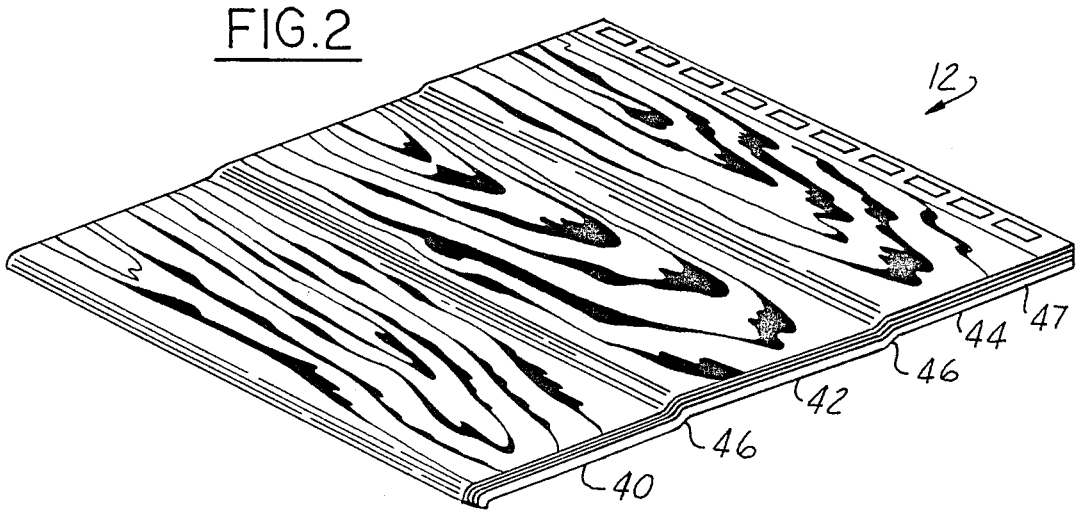

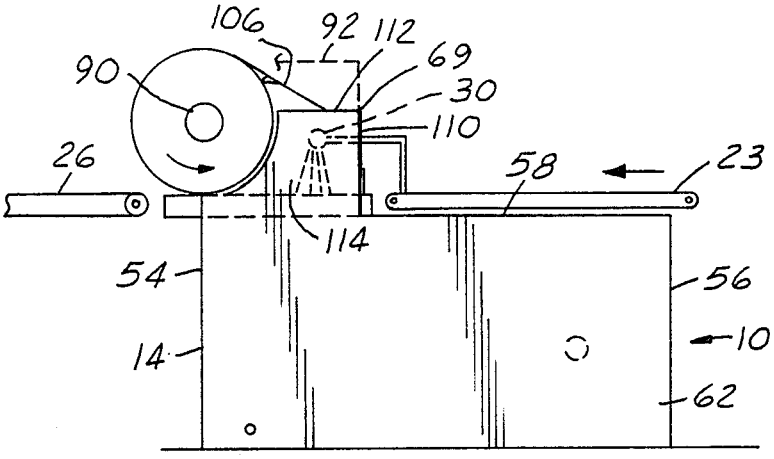
FIG.5
FIG.6
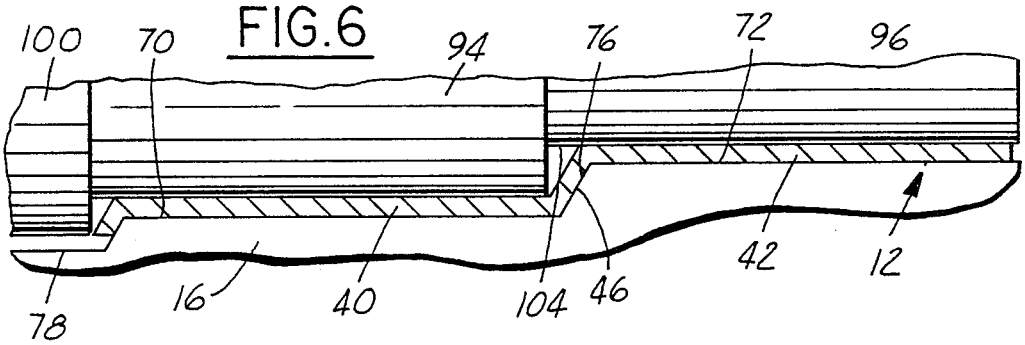
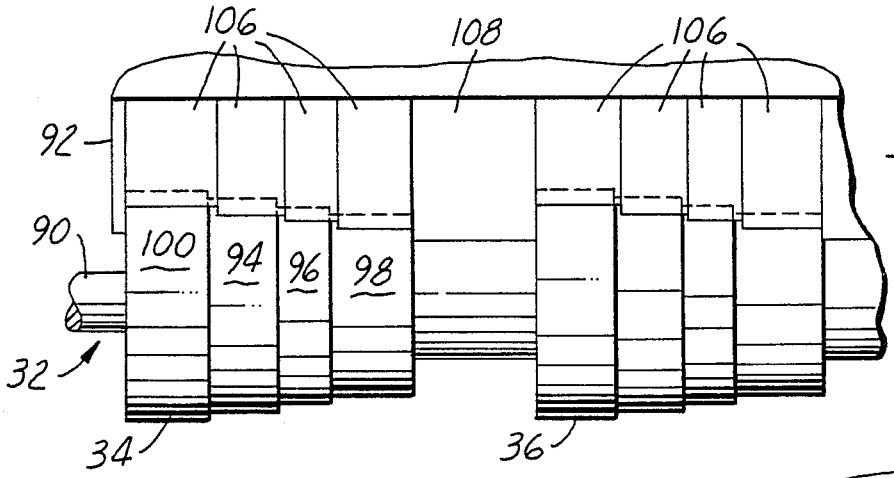
FIG.7
FIG.8
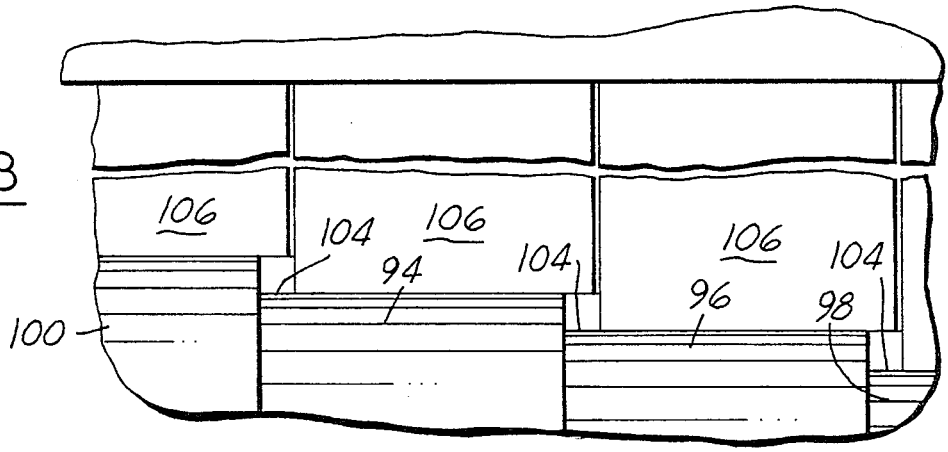

METHOD AND APPARATUS FOR ACCENT COATING OF LAP PANELS

This invention relates generally to theh coating of panels and more particularly to a method and apparatus for the accent coating of embossed and stepped panels of the type typically used in lap siding.

BACKGROUND OF THE INVENTION

In a conventional method of accenting an embossed and flat board surface, the board is flooded with a suitable liquid accent coating after which it is wiped by a smooth roll rotating against the board in the opposite direction of board travel. The roll is of uniform cylindrical shape throughout its length and wipes the coating off the high areas of the embossed or textured surface, leaving it in the low relief areas. The contrast between the accent coating and the underlying base coat accents or highlights the textured or embossed surface. However, this conventional technique cannot be successfully employed on non-flat, lapped or stepped boards.

Vacuum systems for coating flat panels and like strip material are also well known. One such system is described in U.S. Pat. No. 3,084,662 in which the panel passes through a pool of liquid coating in a chamber. Excess liquid coating is uniformly removed from the panel by a continuous flow of air over the flat surfaces of the panel and into the chamber produced by a vacuum applied to the chamber. U.S. Pat. No. 4,333,417 is a further example of use of this vacuum technology in coating a flat strip of material. This technology cannot apply an accent coating to an embossed or textured surface to produce the contrast required for a satisfactory two tone or accented effect.

SUMMARY OF THE INVENTION

The method and apparatus of the present invention is particularly adapted for use in the coating of embossed and stepped panels of the type used in lap siding. In accordance with the invention, a pool of liquid accent coating is sprayed or poured on the panel over a dry film of a base coating of a contrasting color. The aaccent coating is then wiped from portions of the textured surface by a reverse roll which has steps or sections of different diameter designed to match generally the contour of the stepped surfaces of the panel to produce an accented effect on the embossed panel surfaces. The roll portions wipe the high areaas of the embossed surfaces to create a high level of contrast with those relieved portions of the embossed surface on which a greater amount of coating material remains.

The roll sections are constructed to match the contour of the surface of the panel except in the drip edge or stepped areas. Such areas are left open and are not contacted by the roll and remain more heavily coated with the accent coating material, thus creating a dark shadow line.

The coating is removed from the roll sections by doctor blades, except for those portions of the roll sections which do not contact the drip edge or stepped areas of the panel, where excess coating is removed by a flow of air between the roll and the blades. Preferably the flow of air is created by a vacuum. The vacuum also produces an air flow between the roll and the panel in the stepped areas to remove excess accent coating which would otherwise build up or collect along the drip edges or stepped areas of the panel. However, sufficient accent coating remains along the unwiped drip edges or stepped areas of the panel to provide a contrasting dark shadow line.

Objects, features and advantages of this invention are to provide a method and apparatus for accent or two tone coating of panels which are embossed and stepped, and which is easy to control and use, reliable, economical, repeatable and consistently produces a rugged, durable, and aesthetically pleasing high quality finish which weathers well.

These and other objects, features and advantages of the invention will be more apparent from the following detailed description, appended claims and the accompanying drawings.

BRIEF DESCRIPTION OF THE DRAWINGS

FIG. 1 is an exploded view in perspective, showing a stepped panel of the type used in lap siding having a board or substrate upon which are applied a base coat layer, accent layer and clear top coat.

FIG. 2 is a perspective view of the panel shown in FIG. 1.

Figure 3:
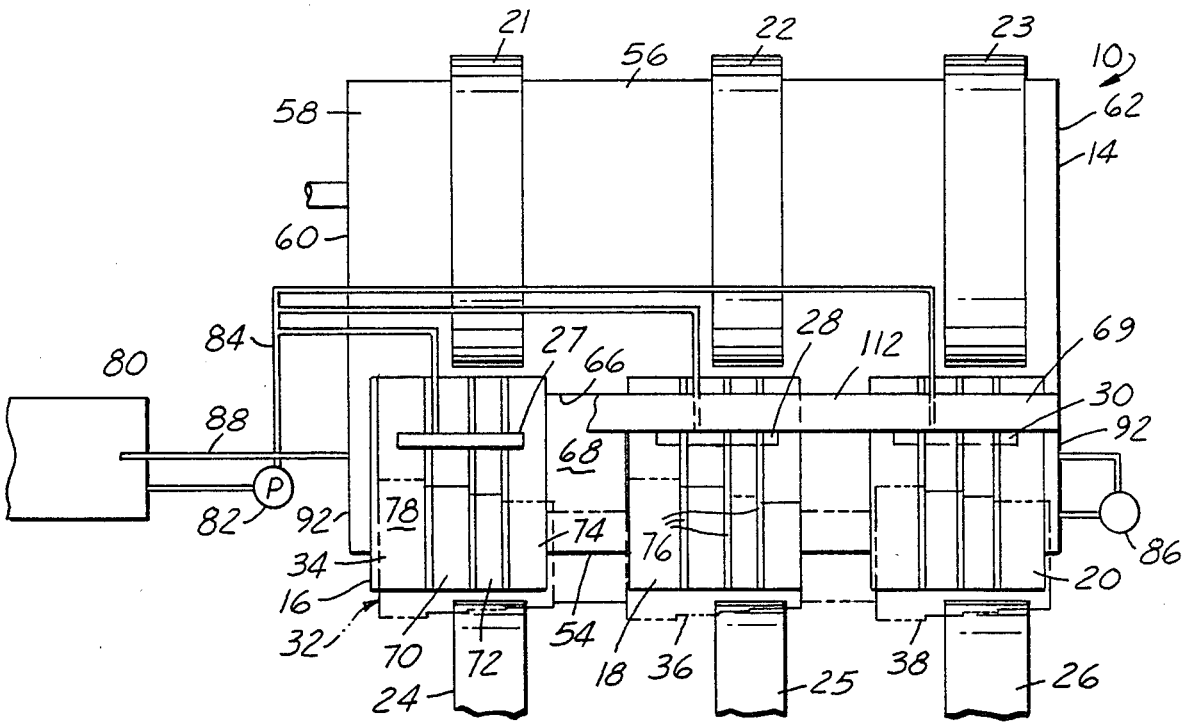
FIG. 3 is a top view of apparatus for applying liquid accent coating to the panel of FIGS. 1 and 2 according to the method of this invention, with the doctor blades omitted for clarity.

Fgure 4 is a front view, with parts in phantom lines and in section, of the apparatus shown in FIG. 3.

Figure 4:
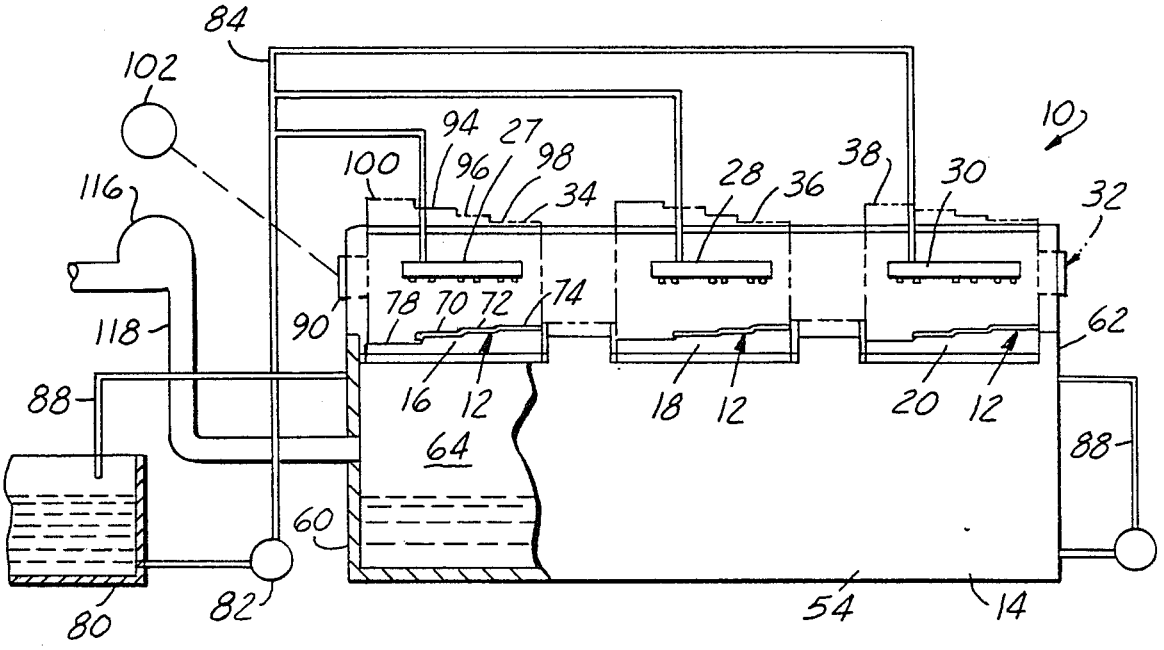

FIG. 5 is a side view of the apparatus shown in FIGS. 3 and 4.

FIG. 6 is an enlarged fragmentary view with parts in section, showing the roll sections in wiping contact with the offfset portions of a panel, except in the stepped areas.

FIG. 7 is a fragmentary top view showing the doctor blades in contact with the different diameter sections of the rolls, except in the stepped areas.

FIG. 8 is an enlarged view of a portion of the structure shown in FIG. 7, but at a different angle to better illustrate the areas of the roll portions not contacted by the doctor blades.

DETAILED DESCRIPTION

Referring now more particularly to the drawings, there is shown a machine or apparatus 10 for coating panels 12. Such apparatus comprises a tank 14 on which slide plates 16, 18, and 20 are mounted and over which panels to be coated are moved by infeed conveyors 21, 22 and 23 and outfeed conveyors 24, 25 and 26. Spray heads 27, 28 and 30 apply a liquid accent coating on the panels. A roll assembly 32 has rolls 34, 36 and 38 for wiping coating from the panels as they pass over the slide plates.

The panels 12 are embossed, stepped panels of the type used in lap siding. Each panel has three panel portions 40, 42 and 44 which extend lengthwise of the panel in generally parallel planes offset from one another and joined together by transition zones in the form of inclined slanted steps 46 (See FIG. 6) between adjacent panel portions. While a three step panel is shown, the panel may have only two steps or more than three steps. It will also be understood that the panel portions may have other than flat, parallel, planar surfaces.

As seen in FIG. 1, the panels each consist of an embossed, stepped, substrate or board 47 coated on one side with a base coat layer 48 and an accent layer 50 followed by a clear top coat 52. Preferably each layer is applied as a liquid coating and cured to a dry film or layer before the next layer is applied. The basecoat and accent layers are of different hues, shades or colors and preferably the accent layer is darker than the base coat layer.

The panels 12, with the base coat layer 48 previously applied to the board 47, are coated with the accent layer 50 in accordance with the method of this invention and by the use of the apparatus shown in the drawings.

The tank 14 has front, rear, top and side walls 54, 56, 58, 60 and 62 which define a chamber 64. The top wall 58 terminates short of the front wall 54 along the line 66, leaving and open section 68 in the top wall which is effectively closed by the roll assembly 32 and hood 69 as described hereinafter, so that the chamber 64 is substantially a closed chamber.

The slide plates 16, 18 and 20 are horizontal, rectangular plates rigidly secured in laterally spaced relation to the top of the tank 14 at the front. The plates overlie the opening 68 in the top wall 58 of the tank and extend forwardly beyond the front wall 54. The top of the slide plates are stepped to correspond to the stepped shape of the panels. Thus, the top of each slide plate has elongated, horizontal top surface portions 70, 72 and 74 corresponding in width to the panel portons 40, 42 and 44 and offset from one another substantially the same distance as the offset of the panel portions to provide steps 76 between adjacent surface portions. The top surface has an additional surface portion 78 offset by a step 76 to accommodate a panel with four offset or stepped panel portions instead of three.

Panels 12 are fed lengthwise and in sequence to the slide plates 16, 18 and 20 by the infeed conveyors 21, 22 and 23, and are carried away from the slide plates by the outfeed conveyors 24, 25 and 26. The panels move continuously and while on the slide plates, the panel portions 40, 42 and 44 are respectively supported by the top surface portions 70, 72 and 74 of the slide plates.

As the panels move over the slide plates, they are flooded with a pigmented, accent liquid coating from spray heads 27, 28 and 30 which are positioned over the opening 68 in the top of the tank. The coating is drawn from a supply tank 80 by a feed pump 82 and delivered to the spray heads through feed lines 84. The excess coating that drops through the opening 68 in the top of the tank 14 collects in the bottom of the tank as shown in FIG. 4. A pump 86 returns the coating collected in the tank 14 to the supply tank 80 through return line 88.

The accent coating may, for example, be a pigmented thermoset acrylic latex.

The roll assembly 32 is located beyond the spray heads in the direction of panel movement. The roll assembly is positioned above the front ends of the slide plates at right angles to the direction of panel movement. Roll shaft 90 is journalled for rotation in upward extensions 92 of the side walls 60 and 62 of tank 14 and is directly above the front wall 54 of tank 14. The rolls 34, 36 and 38 are rigidly secured to the roll shaft axis in positions directly above the respective slide plates 16, 18 and 20.

Each of the rolls 34, 36 and 38 has a plurality of cylindrical roll portions 94, 96, 98 and 100 arranged in an axially contiguous series of progressively smaller radius from one end to the other. The roll portions of each roll are respectiveley located directly above the top surface portions 70, 72, 74 and 78 of one of the slide plates and preferably spaced slightly therefrom so as to have a wiping contact with the panel portions of panels moving over the slide plates to remove some of the coating. Suitable means, such as motor 102, rotates the roll assembly so that the rolls reverse rotate, that is, turn in a direction such that their undersurfaces move oppositely to the direction of movement of the panels through the machine (see FIG. 5).

The roll portions of the rolls contact and wipe the panel portions over a major portion of their width, but do not contact or wipe the steps of the panel portions. The noncontacting portion of each roll portion is designated 104.

Doctor blades 106 are provided for the rolls, preferably a separate one for each roll portion of each roll. The doctor blades contact the roll portions over a major portion of their width, but do not contact the parts 104 thereof. Coating material wiped from the panels is wiped from the roll portions by the doctor blades. Additional blades 108 contact the roll shaft 90 between the rolls 34, 36 and 38.

The blades 106 an 108 are carried by the hood 69. These blades are substantially edge to edge from one side wall extension 92 of the tank to the other. The hood 69 has a rear wall 110 rearwardly of spray heads 27, 28 and 30 extending upwardly from the fron edge 66 of the top wall 58 of tank 14, a top wall 112 above the spray heads, and side walls 114. Side walls 114 are very closely spaced from and curved to conform to the outermost roll portions of the rolls 34 and 38. The front wall 56 of the tank has baffles 116 which engage the roll shaft 90 and fill the space between the rolls. The rolls 34 and 38 are closely confined between the side wall extensions 92 of the tank. According to this construction, the roll assembly 32, blades 106 and 108, hood 69 and baffles 116 close the opening 68 in the top of the tank 14, so that the chamber 64 within the tank is substantially a closed chamber.

To remove excess accent coating from the steps of the panels and the doctor blades, a vacuum is applied to the chamber 64. The chamber 64 is maintained under vacuum, that is, under a reduced pressure less than atmospheric pressure, by a vacuum pump 116 connected by piping 118 to the chamber.

In use, panels are advanced through the machine in the direction of the arrow in FIG. 5 by the infeed conveyors 21, 22 and 23 and the outfeed conveyors 24, 25 and 26. During such movement, the panels pass over the slide plates 16, 18 and 20 where the panel portions 40, 42 and 44 are respectively supported by the top surface portions 70, 72 and 74 of the slide plates.

As the panels move over the slide plates, they are flooded with the pigmented, accent coating from spray heads 27, 28 and 30.

The rolls 34, 36 and 38 are reverse rotated in the direction of the arrow in FIG. 5. The roll portions have a wiping contact with the panel portions as the panels continue their movement over the slide plates beyond the spray heads. The roll portions wipe the high points of the embossed panel surfaces to remove some of the liquid accent coating and thereby create a high level of contrast with the relief portions on which a greater amount of coating remains.

The roll portions do not contact or wipe the steps of the panels so that such stepped portions of the panels remain more heavily coated with the coating material to create a dark shadow line. However, the vacuum in the tank draws air between the rolls and the panels in the drip edge or stepped areas of the panels, to remove excess coating from the step areas.

The doctor blades 106 strip coating from the rolls, except for those portions of the rolls which do not contact the stepped areas of the panels. In those portions of the rolls not contacted by the doctor blades, excess coating is removed by the flow of air between the rolls and the blades created by the vacuum in the tank. This air flow also removes the excess coating from the doctor blades.

The panels are advanced through the applicator machine 10 at the rate of about 50 to 300 and preferably 100 to 200 lineal feet per minute. Usually, the rolls have a diameter in the range of about 8 to 12 and preferably 9 to 11 inches and are reverse rotated at a speed of about 20 to 100 r.p.m. and preferably 30 to 40 r.p.m., which is the equivalent of about 60 to 300 and preferably 100 to 150 surface feet per minute. Typically, the opening between each step of the panels and the adjacent portions of the roll has an area in the range of about 0.400 to 0.450, preferably 0.420 to 0.430 square inch. Similarly, each opening between an edge of a roll portion and the adjacent doctor blades usually has an area of 0.05 to 0.07 and preferably 0.06 to 0.065 square inch.

In operation, a vacuum of about 5 to 15 and preferably 10 to 12 inches of water is applied to the closed chamber 64. Consequently, the air flow rate through each opening between the panel and adjacent portions of the roll is believed to be about 150 to 400 standard cubic feet per minute (SCFM), and the air flow rate through each opening between an edge of a roll portion and the adjacent doctor blades about 20 to 30 SCFM. In practice, these flow rates are varied and adjusted by varying the extent of the vacuum applied in the chamber, to remove sufficient coating from the panels in the areas 104 to ultimately deposit the desired amount of liquid coating in these areas.

The amount of liquid coating removed from the embossed surfaces of the panel portion by the roll is varied and controlled by adjusting the pressure or total force with which the roll bears on a panel when it passes under it. This total force can be varied and adjusted by changing the gap or distance between the roll and the underlying slide plates between which the panel passes. For a panel having a nominal thickness of about 0.125 of an inch, this gap is usually about 0.110 to 0.110 of an inch, or about 80 to 88% of the nominal thickness of the panel. The quantity of coating removed by the roll from the embossed surface is also a function of the resiliency of the roll material. Typically, the roll is made of an E.P.D.M. material having a durometer in the range of about 30 to 40 on the Shore A Scale.

Preferably, the accent coating is a thermal set acrylic latex paint, such as Gray 891-E-30101 commercially available from The Glidden Company of Detroit, Mich. When supplied to the spray heads for being directed as streams of liquid onto the panels, the coating preferably has a viscosity in the range of about 15 to 18 and preferably about 15 to 16 seconds in a Zahn #2 cup. Usually, this coating is supplied to the spray heads at a pressure of about 10 to 20 pounds per square inch gauge.

After the coated panels emerge from the apparatus 10, they are usually conveyed through a forced hot air oven for about 10 to 20 seconds when it is operating at a temperature of about 400° to 500°0 F. After the accent coat has been cured to a dry film or layer, a transparent top coat such as a thermoset acrylic latex paint is usually applied to the panel and cured to a dry film or layer. A liquid thermoset acrylic latex top coat can be applied by a curtain coater and then cured to a dry film tenaciously adhering to and protecting the base and accent coats by passing the panel through a forced hot air dryer for about 15 to 20 seconds operating at a temperature of about 200° to 300° F. Preferably, full curing of the thermoset acrylic latex top coat is accelerated by subsequently passing the panel through an infrared dryer for about 15 to 20 seconds which heats the top coat to an exterior surface temperature of about 340° to 360° F.

What is claimed is:

1. A method of coating panels having a plurality of embossed panel portions extending lengthwise thereof and at least one transition zone connecting the adjacent embossed panel portions, comprising the steps of moving said panels lengthwise along a predetermined path, and, during movement of said panels along said path, applying a liquid coating to said panel portions and transition zones of said panels, wiping only some of the liquid coating thus applied from said embossed panel portions but not wiping said transition zones, and withdrawing excess liquid coating thus applied from said transition zones by a flow of gas over and closely adjacent thereto.

2. A method as define in claim 1, wherein the wiping of aid panels is accomplished by providing along said path a roll having a plurality of roll portions respectively juxtaposed to said panel portions and of appropriate radius to contact said panel portions but not to contact said transition zones, and reverse rotating said roll.

3. A method as defined in claim 2, including removing by doctor blades coating from said roll portions but not from the portions thereof which do not conact said transition zones.

4. A method as defined in claim 3, including removing by a flow of gas coating from said doctor blades.

5. A method as defined in claim 3, including removing by a flow of gas coating from the portions of said roll portions which do not contact said transition zones.

6. A method of coating panels having a plurality of embossed panel portions extending lengthwise thereof in generally parallel planes offset from one another to provide a step between the adjacent embossed panel portions, comprising the steps of moving said panels lengthwise along a predetermined path, and, during movement of said panels along said path, applying a liquid coating to said panel portions and steps of said panels, wiping only some of the liquid coating thus applied from said embossed panel portions but not wiping said steps, and withdrawing excess liquid coating thus applied from said steps by a flow of gas over and closely adjacent to said steps.

7. A method as defined in claim 6, including withdrawing excess coating from said steps by utilizing a vacuum to produce such flow of gas.

8. A method as defined in claim 6, wherein the wiping of said panels is accomplished by providing along said path a roll having a plurality of cylindrical roll portions respectively juxtaposed to said panel portions and of differing radius to contact said panel portions, and reverse rotating said roll.

9. A method as defined in claim 8, wherein the peripheries of said roll portions match generally the contour of said panels except in the stepped areas thereof in order not to contact or wipe said steps.

10. A method as defined in claim 9, including removing by doctor blades coating from said roll portions but not from those portions thereof which do not contact said steps.

11. A method as defined in claim 10, including withdrawing by vacuum coating from the portions of said rolls which do not contact said steps and from said doctor blades.

12. Apparatus for coating panels having a plurality of embossed panel portions extending lengthwise thereof and at least one transition zone connecting the adjacent embossed panel portions, compising means for moving said panels lengthwise along a predetermined path, a roll, means supporting said roll in a position extending across the path of panel movement, said roll having a plurality of roll portions respectively juxtaposed to said embossed panel portions and of appropriate radius to contact said embossed panel portions but not to contact said transition zones, means for applying a liquid coating to such embossed panel portions and transition zones of said panels upstream of said roll, means for reverse rotating said roll to wipe some of such liquid coating from said embossed panel portions without wiping said transition zones, and means for producing a flow of gas over and closely adjacent to said transition zones to withdraw excess liquid coating therefrom.

13. Apparatus as defined in claim 12, including doctor blades for removing coating from said roll portions but not from the portions thereof which do not contact said transition zones.

14. Apparatus as defined in claim 13, wherein said flow of gas is effective to remove coating from said doctor blades.

15. Apparatus as defined in claim 3, wherein said flow of gas is effective to remove coating from the portions of said rolls which do not contact said transition zones.

16. Apparatus for coating panels having a plurality of embossed panel portions extending lengthwise thereof in generally parallel planes offset from one another to provide a step between the adjacent embossed panel portions, comprising means for moving said panels lengthwise along a predetermined path, a roll, means supporting said roll in a position extending across the path of panel movement, said roll having a plurality of cylindrical roll portions respectively juxtaposed to said embossed panel portions and of differing radius to contact said embossed panel portions, means for applying a liquid coating to such embossed panel portions and steps of said panels upstream of said roll, means for reverse rotating said roll to wipe some of such liquid coating from said embossed paneel portions without wiping said steps, and means for producing a flow of gas over and closely adjacent to said steps to withdraw excess liquid coating from such steps.

17. Apparatus as defined in claim 16, wherein said roll portions are arranged in an axially contiguous, stepped series of two or more.

18. Apparatus as defined in claim 16, wherein the peripheries of said roll portions match generally the contour of said panels except in the stepped areas thereof in order not to contact or wipe said steps.

19. Apparatus as defined in claim 18, wherein said roll portions are arranged in an axially contiguous series of progressively smaller radius from one end of the series to the other.

20. Apparatus as defined in claim 18, wherein said means for producing a flow of gas comprises a vacuum means for withdrawing excess coating from the steps of said panels.

21. Apparatus as defined in claim 18, including wiper means for removing coating from said roll portions but not from those portions thereof which do not contact said steps.

22. Apparatus as defined in claim 21, wherein said flow of gas is effective to withdraw excess coating from said roll portions not removed by said wiper means.

23. Apparatus as defined in claim 21, wherein said flow of gas is effective to remove coating from said wiper means.

24. Apparatus for accent coating panels having a plurality of embossed panel portions extending lengthwise thereof in generally parallel planes offset from one another to provide a step between the adjacent embossed panel portons, comprising means for moving said panels lengthwise along a predetermined path, a roll, means supporting said roll in a position extending across the path of panel movement, said roll having a plurality of cylindrical roll portions respectively juxtaposed to said embossed panel portions, means for applying an accent coating to the embossed panel portions and steps of said panels upstream of said roll, and means for reverse rotating said roll to wipe coating from said embossed panel portions, the peripheries of said roll portions matching generally the contour of said panels except in the stepped areas thereof in order not to contact or wipe said steps, and vacuum means for withdrawing excess liquid coating from the steps of said panels.

25. Apparatus as defined in claim 24, including doctor blades contacting said roll portions, but not those parts thereof which do not contact said steps, for removing coating therefrom, and vacuum means for withdrawing excess coating from said doctor blades and from said parts of said roll portions not contacted by said doctor blades.

26. Apparatus as defined in claim 25, including means for supporting said panels while being wiped by said roll comprising a slide plate having a panel-supporting surface matching generally the contour of said panels.

* * * * *

UNITED STATES PATENT AND TRADEMARK OFFICE

CERTIFICATE OF CORRECTION

PATENT NO. : 4,871,588

DATED : October 3, 1989

INVENTOR(S) : Jared G. Cuddy et al

It is certified that error appears in the above-identified patent and that said Letters Patent is hereby corrected as shown below:

Column 6, line 24, "aid" should be -- said --

Column 7, line 53,"paneel" should be -- panel --

Signed and Sealed this

Twenty-eighth Day of August, 1990

*Attest:*

HARRY F. MANBECK, JR.

*Attesting Officer*

*Commissioner of Patents and Trademarks*